US009117559B2

(12) United States Patent
Chang

(10) Patent No.: US 9,117,559 B2
(45) Date of Patent: Aug. 25, 2015

(54) METHOD FOR PORTIONING HIGH RADIATION INTENSITY WASTE

(75) Inventor: Kuo-Yuan Chang, Taoyuan County (TW)

(73) Assignee: INSTITUTE OF NUCLEAR ENERGY RESEARCH, Jiaan Village, Longtan, Taoyuan (TW)

( * ) Notice: Subject to any disclaimer, the term of this patent is extended or adjusted under 35 U.S.C. 154(b) by 630 days.

(21) Appl. No.: 13/525,384

(22) Filed: Jun. 18, 2012

(65) Prior Publication Data

US 2013/0333329 A1 Dec. 19, 2013

(51) Int. Cl.

| | |
|---|---|
| ***G21F 5/14*** | (2006.01) |
| ***G21F 9/04*** | (2006.01) |
| ***G21F 9/06*** | (2006.01) |
| ***G21F 9/28*** | (2006.01) |
| ***G21F 9/30*** | (2006.01) |
| ***G21F 9/36*** | (2006.01) |

(52) U.S. Cl.

CPC .. *G21F 5/14* (2013.01); *G21F 9/04* (2013.01); *G21F 9/06* (2013.01); *G21F 9/28* (2013.01); *G21F 9/30* (2013.01); *G21F 9/36* (2013.01)

(58) Field of Classification Search

CPC ..... G21F 5/14; G21F 9/04; G21F 9/06; G21F 9/28; G21F 9/30; G21F 9/36

USPC ..... 53/428, 449, 111 R, 171, 173; 588/16, 588/20; 976/DIG. 352, DIG. 379, DIG. 380, 976/DIG. 381, DIG. 391, DIG. 392, DIG. 395

See application file for complete search history.

(56) References Cited

U.S. PATENT DOCUMENTS

| | | | | |
|---|---|---|---|---|
| 3,448,859 | A * | 6/1969 | Hall et al. | 210/770 |
| 3,658,179 | A * | 4/1972 | Baumann et al. | 588/3 |
| 4,168,243 | A * | 9/1979 | Gablin et al. | 588/6 |
| 4,222,889 | A * | 9/1980 | Uerpmann | 588/8 |
| 4,595,528 | A * | 6/1986 | Greenhalgh | 588/12 |
| 5,298,196 | A * | 3/1994 | Heung | 588/16 |
| 5,566,727 | A * | 10/1996 | Erbse et al. | 141/7 |
| 6,040,491 | A * | 3/2000 | Sjowall | 588/16 |
| 2011/0139700 | A1 * | 6/2011 | Chu et al. | 210/248 |

FOREIGN PATENT DOCUMENTS

| | | | | |
|---|---|---|---|---|
| CH | 575640 | A5 * | 5/1976 | G21F 9/36 |

* cited by examiner

*Primary Examiner* — Stephen F Gerrity

(57) ABSTRACT

The present invention is directed to a method for portioning high radiation intensity waste and an apparatus thereof. A hanging mechanism hangs both a manual lifting mechanism and a lead shield, wherein the manual lifting mechanism is provided with a net basket hanging chain extending downwards, wherein the net basket hanging chain can be manipulated to be lifted or lowered. The net basket hanging chain is secured to a net basket containing the high radiation intensity waste. The lead shield is arranged under the hanging mechanism and in a path, along which the net basket is lifted or lowered, wherein the lead shield is provided with a space having an opening facing down.

2 Claims, 7 Drawing Sheets

METHOD FOR PORTIONING HIGH RADIATION INTENSITY WASTE

BACKGROUND OF THE INVENTION

1. Field of the Invention

The present invention relates to a method for portioning high radiation intensity waste and an apparatus thereof, and more particularly, to a portioning method employed for avoiding exposure to the environment with high radiation intensity during a portioning process, wherein a container for temporary storage and employed has functions of sealing, filtering and pressure venting.

2. Brief Description of the Related Art

High radiation intensity waste, generated in a nuclear industry, cannot be transferred to a container for storing the waste in a long term because the waste has some parts having not been developed with continuously stable forms yet. Accordingly, the waste is requested to be temporarily portioned and stored. In order to avoid air pollution and reduce damages to humans and the environment, the high radiation intensity waste is often stored under water. However, when the container does not have enough space or is planned to be decommissioned, the waste has to be disposed or processed. At this time, the high radiation intensity waste stored under water has to be shifted out and then disposed for stabilization. Thereby, the waste can be stored in a long term. An operator must be careful to move the high radiation intensity waste stored under water out of a surface of the water, and thereby can be prevented from excessive radiation doses. Besides, a container having functions of sealing, filtering and pressure venting is necessary to be provided for temporary storage so as to avoid air accumulation releasing due to chemical changes created by the high radiation intensity waste and avoid air pollution.

With regards to portioning and temporarily storing the high radiation intensity waste, it is a popular way that a protection or separation of operators from radiation is first done, and then the operators can operate associated facilities to load the high radiation intensity waste in a shielding container for temporary storage. However, the operating environment is not effectively isolated from the high radiation intensity waste, and pollution or leakage of radioactive materials cannot be adaptively limited in a relatively small space such that the operators and the associated facilities are exposed to a dangerous environment. Besides, the high radiation intensity waste after being formed is analyzed for its radioactive nuclides and chemical properties. Some radioactive materials with specific forms are necessary to be stored for stabilization in a bucket container for a long term. In this temporary storage, air accumulation is possibly created due to radiation cleavage in the container. This would lead the container to be deformed or damaged, or would cause explosion. Accordingly, the shielding container for temporary storage should be considered to have functions of shielding, filtering and pressure venting and to be easy to be reprocessed.

Accordingly, here is an important issue of how to effectively and safely portion and temporarily store the high radiation intensity waste before stabilized, with considering suppression of radiation doses to the operators, radiation safety, the container and withdrawal of the waste to be processed.

In view of the above shortcomings of the traditional method for disposing the high radiation intensity waste and apparatus thereof, the present invention is provided to improve these shortcomings.

SUMMARY OF THE INVENTION

It is an object of the present invention to provide a method for portioning high radiation intensity waste so as to reduce the quantity of a batch of waste and the activity thereof and improve the operating environment.

It is another object of the present invention to provide a method for portioning high radiation intensity waste, including using a lead shield to hang the waste out of water such that radiation doses to the operators during operation can be reduced.

It is a further object of the present invention to provide a method for portioning high radiation intensity waste, wherein a shielding container for temporary storage has functions of shielding, filtering and pressure venting and is easy to be reprocessed such that safety in the period of temporary storage can be improved and the requirement to reprocess and stabilize the high radiation intensity waste can be met.

It is yet another object of the present invention to provide a method for portioning high radiation intensity waste, wherein the operator can perform a portioning process outside the lead shield. Thereby, radiation doses to the operators can be effectively reduced, and air pollution can be avoided.

In order to achieve above objectives, a method for portioning high radiation intensity waste includes step S11 of moving a net basket into a water container containing high radiation intensity waste, comprising using a hanging device to move the net basket into the water container storing the high radiation intensity waste and using a pump to pump the high radiation intensity waste, in the water container, into the net basket; step S12 of moving the net basket and the high radiation intensity waste collected in the net basket out of water and putting the waste in a lead shield, comprising lifting the net basket and the high radiation intensity waste collected in the net basket to a space above the water container and putting the waste in the lead shield during lifting the net basket such that the high radiation intensity waste in the net basket can be dried with little radiation leakage; step S13 of moving the net basket and the high radiation intensity waste collected in the net basket to a shielding container for temporary storage, comprising moving the net basket and the dried high radiation intensity waste collected in the net basket to the shielding container for temporary storage; step S15 of sealing the shielding container for temporary storage, comprising sealing the net basket and the dried high radiation intensity waste collected in the net basket in the shielding container for temporary storage.

In accordance with an embodiment, the above method, before step 15 of sealing the shielding container for temporary storage, further includes step 14 of determining if the shielding container for temporary storage is suitable for containing another net basket, comprising confirming if in the shielding container for temporary storage is enough space suitable for accommodating another net basket and performing step 13 of moving another net basket and the high radiation intensity waste collected in the another net basket to the shielding container for temporary storage in response to confirming that in the shielding container for temporary storage is enough space suitable for accommodating another net basket.

In accordance with the present invention, an apparatus for portioning high radiation intensity waste includes a hanging mechanism, a manual lifting mechanism under the hanging mechanism, wherein the manual lifting mechanism is provided with a net basket hanging chain extending downwards, wherein the net basket hanging chain can be manipulated to be lifted or lowered, a net basket hanged on the net basket hanging chain, wherein in the net basket is a space for containing high radiation intensity waste, wherein multiple meshes are provided at a bottom of the space in the net basket, and a lead shield under the hanging mechanism and in a path, along which the net basket is lifted or lowered, wherein the lead shield is provided with a space having an opening facing down for receiving the net basket containing high radiation intensity waste.

In accordance with an embodiment, the manual lifting mechanism is arranged over the lead shield, wherein the lead shield is provided with a through hole at a center of the lead shield, wherein the net basket hanging chain passes through the through hole and joins the net basket.

In accordance with an embodiment, the hanging mechanism is provided with a hook manipulated to be lifted, lowered or laterally moved, wherein the manual lifting mechanism and the lead shield are arranged under the hook.

In accordance with an embodiment, a hanging beam is laterally arranged in an opening at a top side of the space in the net basket, wherein the net basket hanging chain is fixed with the hanging beam.

In accordance with an embodiment, a covering plate is secured over the hanging beam, wherein the covering plate tilts with pivoting of the hanging beam such that the opening at the top side of the space in the net basket can be kept open.

In accordance with an embodiment, a shielding container for temporary storage receives the net basket containing high radiation intensity waste, wherein the shielding container for temporary storage is at least composed of a containing body and a shielding top, wherein in the containing body is a space having an opening for containing the net basket, wherein a shielding body for shielding radiation is at a periphery of the space in the containing body, wherein the shielding top is suitable for sealing and covering the opening of the space of the containing body.

In accordance with an embodiment, the shielding top is provided with a filtering and pressure-venting device.

In accordance with an embodiment, an internal cylinder is further arranged at the periphery of the space in the containing body, and an outer lid is arranged at an outer surface of the shielding top.

In accordance with an embodiment, the high radiation intensity waste is shaped like particles or powder.

The accompanying drawings are included to provide a further understanding of the present invention, and are incorporated as a part of this specification. The drawings illustrate embodiments of the present invention and, together with the description, serve to explain the principles of the present invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
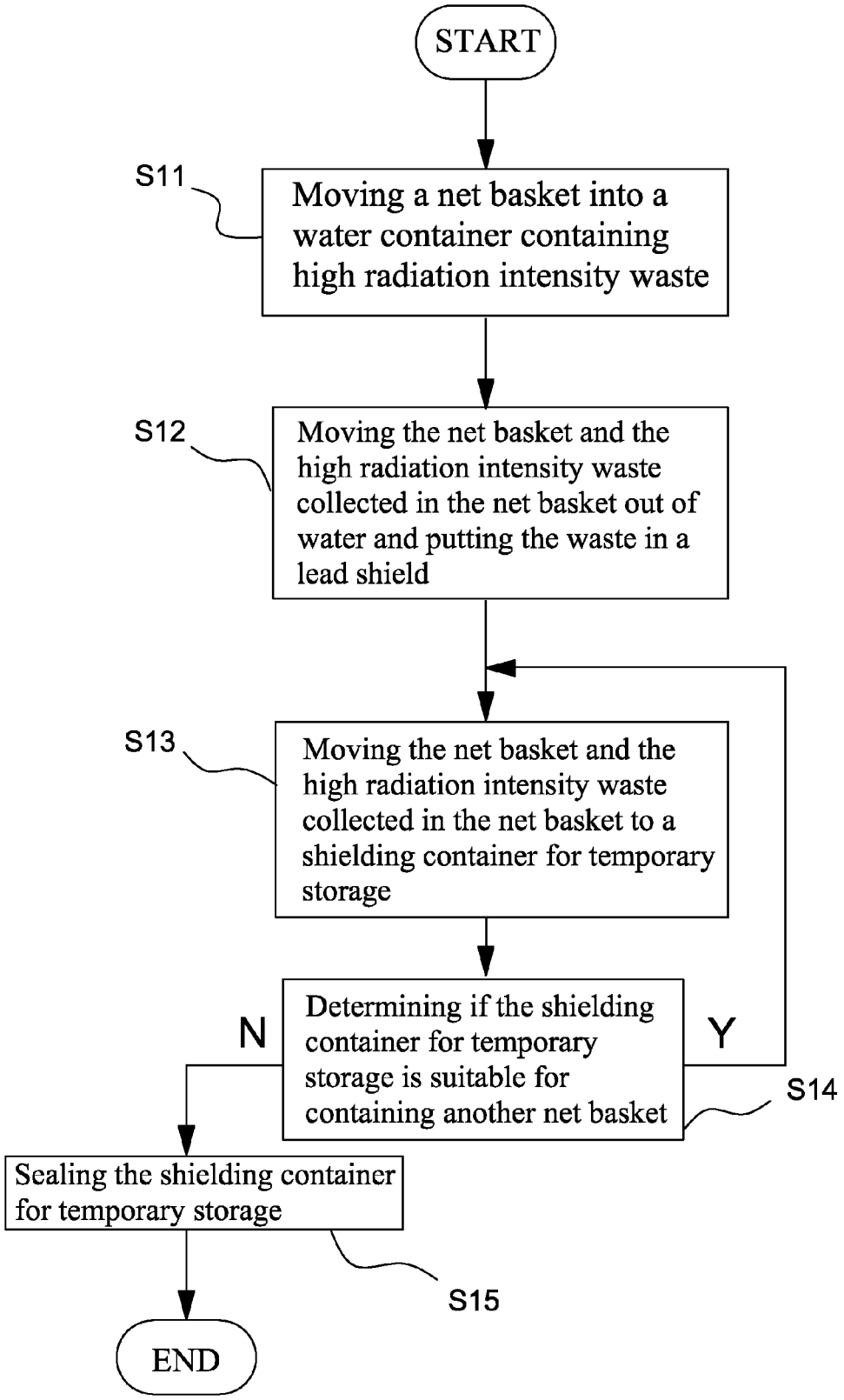
FIG. 1 is a flow chart of a method in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Referring to FIG. 1, a portioning method, in accordance with the present invention, includes step S11 of moving a net basket into a water container containing high radiation intensity waste, step S12 of moving the net basket and the high radiation intensity waste collected in the net basket out of water and putting the waste in a lead shield, step S13 of moving the net basket and the high radiation intensity waste collected in the net basket to a shielding container for temporary storage, step 14 of determining if the shielding container for temporary storage is suitable for containing another net basket, and step S15 of sealing the shielding container for temporary storage.

Figure 2:
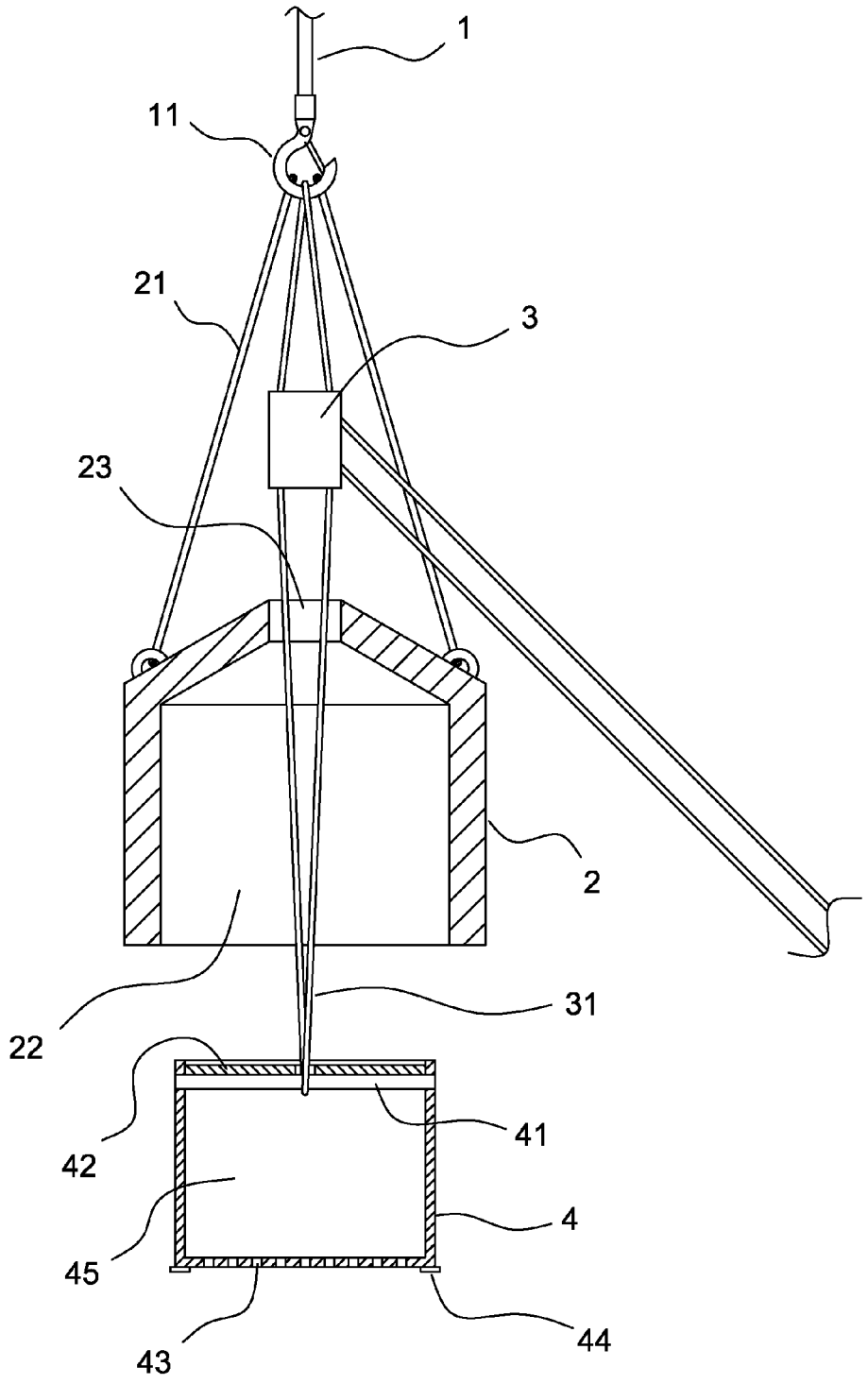
FIG. 2 is a schematic view of structures related to a hanging mechanism in accordance with the present invention.
Figure 3:
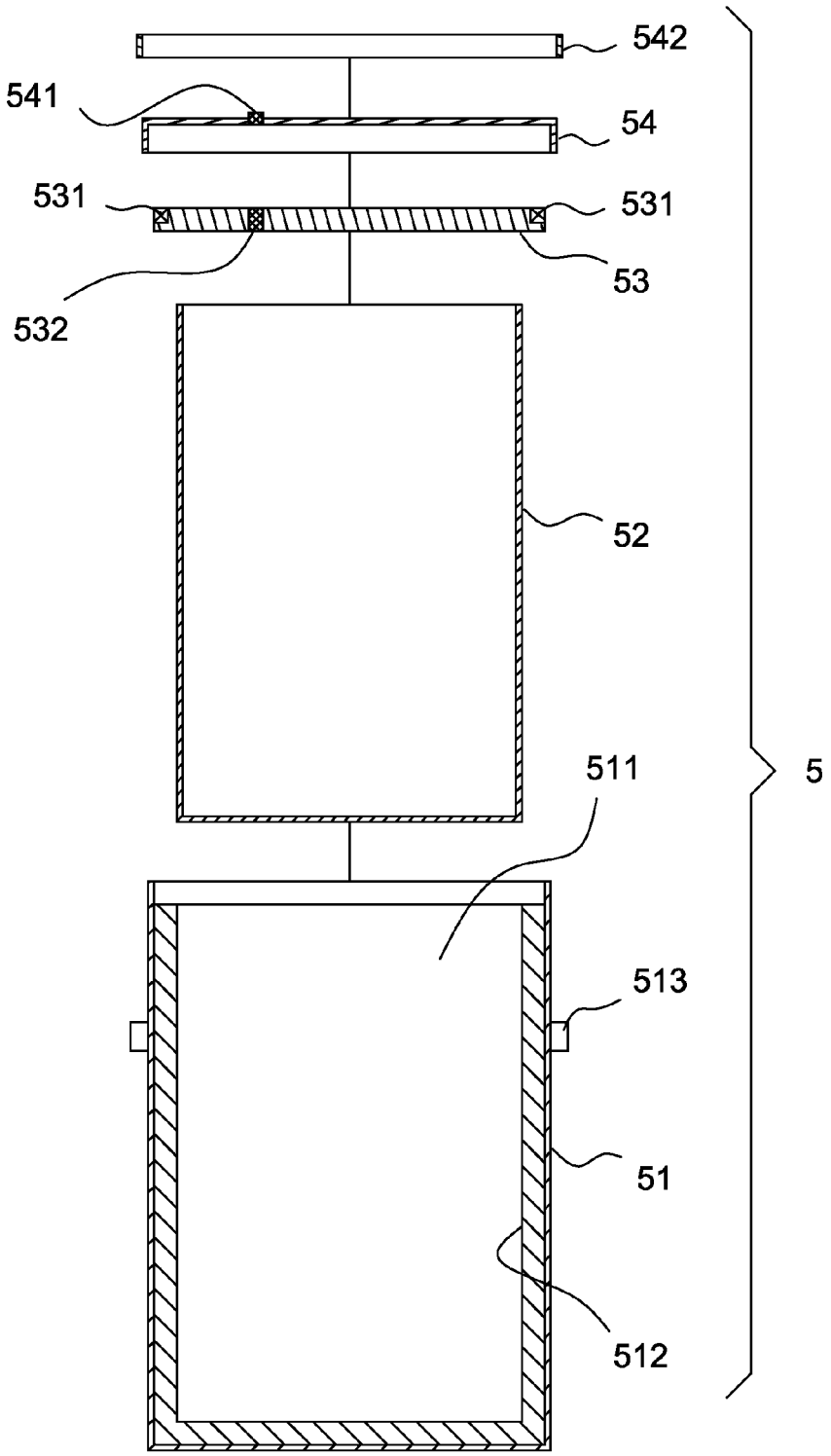
FIG. 3 is an exploded view of a shielding container for temporary storage in accordance with the present invention.

Referring to FIGS. 2 and 3, a portioning apparatus in accordance with the present invention includes a hanging mechanism 1, a lead shield 2, a manual lifting mechanism 3 and a net basket 4. The hanging mechanism 1 is provided with a hook 11 manipulated to be lifted, lowered or laterally moved, wherein the manual lifting mechanism 3 is arranged under the hook 11 of the hanging mechanism 1. The manual lifting mechanism 3 is provided with a net basket hanging chain 31 extending downwards, wherein the net basket hanging chain 31 can be manipulated to be lifted or lowered. Multiple meshes 43 are provided at a bottom of a space 45 in the net basket 4. A hanging beam 41 is laterally arranged in an opening at a top side of the space 45 in the net basket 4, wherein the net basket hanging chain 31 is fixed with the hanging beam 41. A covering plate 42 for covering the opening at the top side of the space 45 is secured over the hanging beam 41, wherein the covering plate 42 tilts with pivoting of the hanging beam 41. Multiple stacked anti-roll plates 44 are arranged at a periphery of a bottom of the net basket 4, and this leads a plurality of the net basket 4 to be easily stacked. The lead shield 2 can be secured to the hook 11 of the hanging mechanism 1 through multiple shield hanging chains 21 and under the manual lifting mechanism 3. The lead shield 2 is provided with a space 22 having an opening facing down for receiving the net basket 4. The net basket hanging chain 31 passes through a through hole 23 at a center of a top of the space 22, and thereby the lead shield 2 can be set in a path, along which the net basket 4 is lifted or lowered.

The net basket 4 can be received in a shielding container 5 for temporary storage. The shielding container 5 for temporary storage is at least composed of a containing body 51 and a shielding top 53, wherein in the containing body 51 is a space 511 having an opening for containing a stacked plurality of the net basket 4. A shielding body 512 for shielding radiation is at a periphery of the space 511 in the containing body 51. An internal cylinder 52 is at a periphery in the shielding body 512. Hanging rings 513 are fixed at a periphery outside the shielding body 512. The shielding top 53 for shielding radiation includes multiple locks 531 fixed at a periphery of the shielding top 53 so as to seal and cover the opening of the space 511. The shielding top 53 is provided with a filtering and pressure-venting device 532. An outer lid 54 is arranged at an outer surface of the shielding top 53 and secured to a top and outer periphery of the shielding top 53 using a sealing ring 542. The outer lid 54 is arranged with a filtering and pressure-venting device 541 corresponding to the position of the filtering and pressure-venting device 532.

Figure 4:
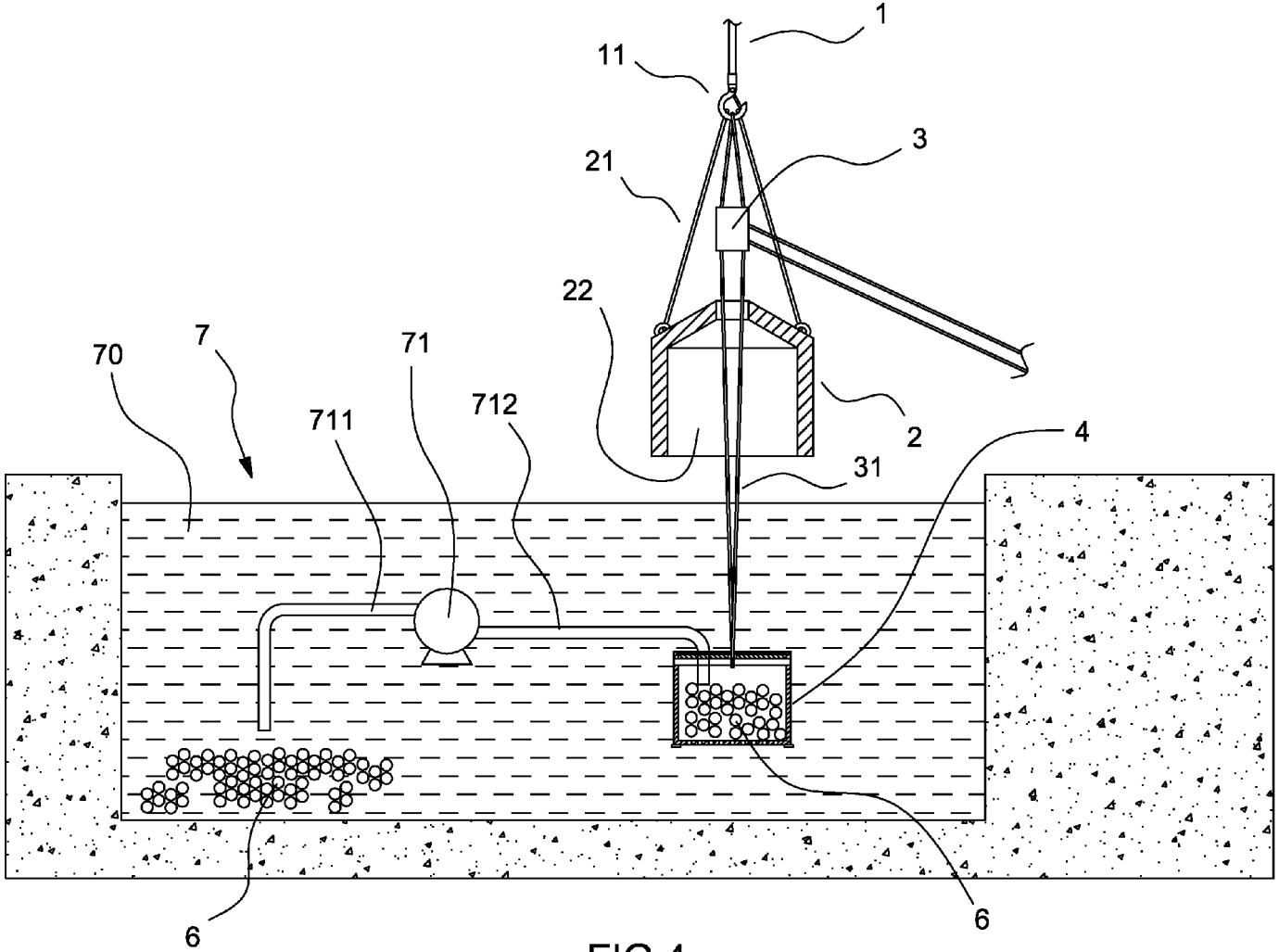
FIG. 4 is a first schematic view showing operation of collecting high radiation intensity waste into a net basket in a container in accordance with the present invention.
Figure 5:
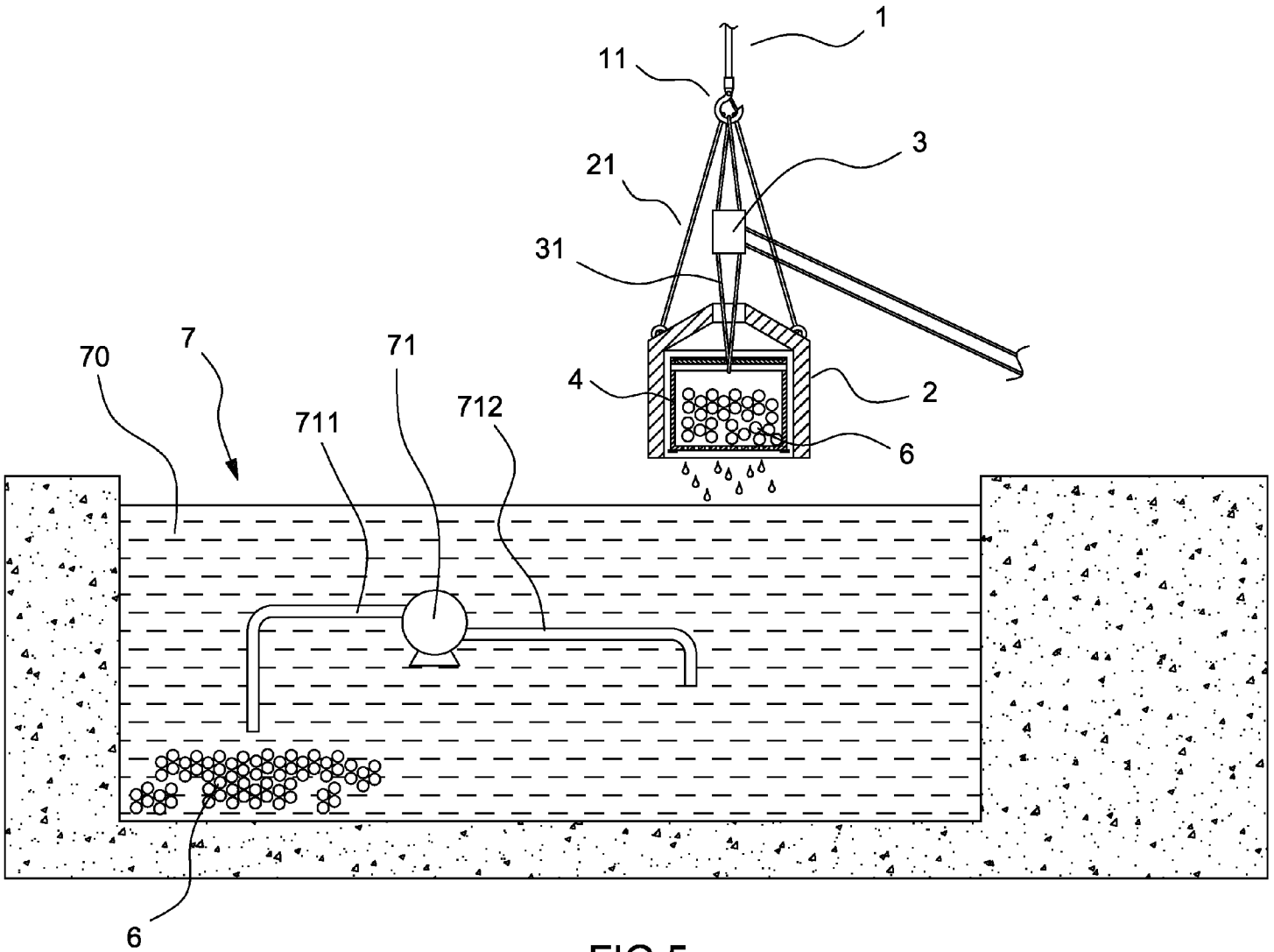
FIG. 5 is a second schematic view showing operation of collecting high radiation intensity waste into the net basket in the container in accordance with the present invention.
Figure 6:
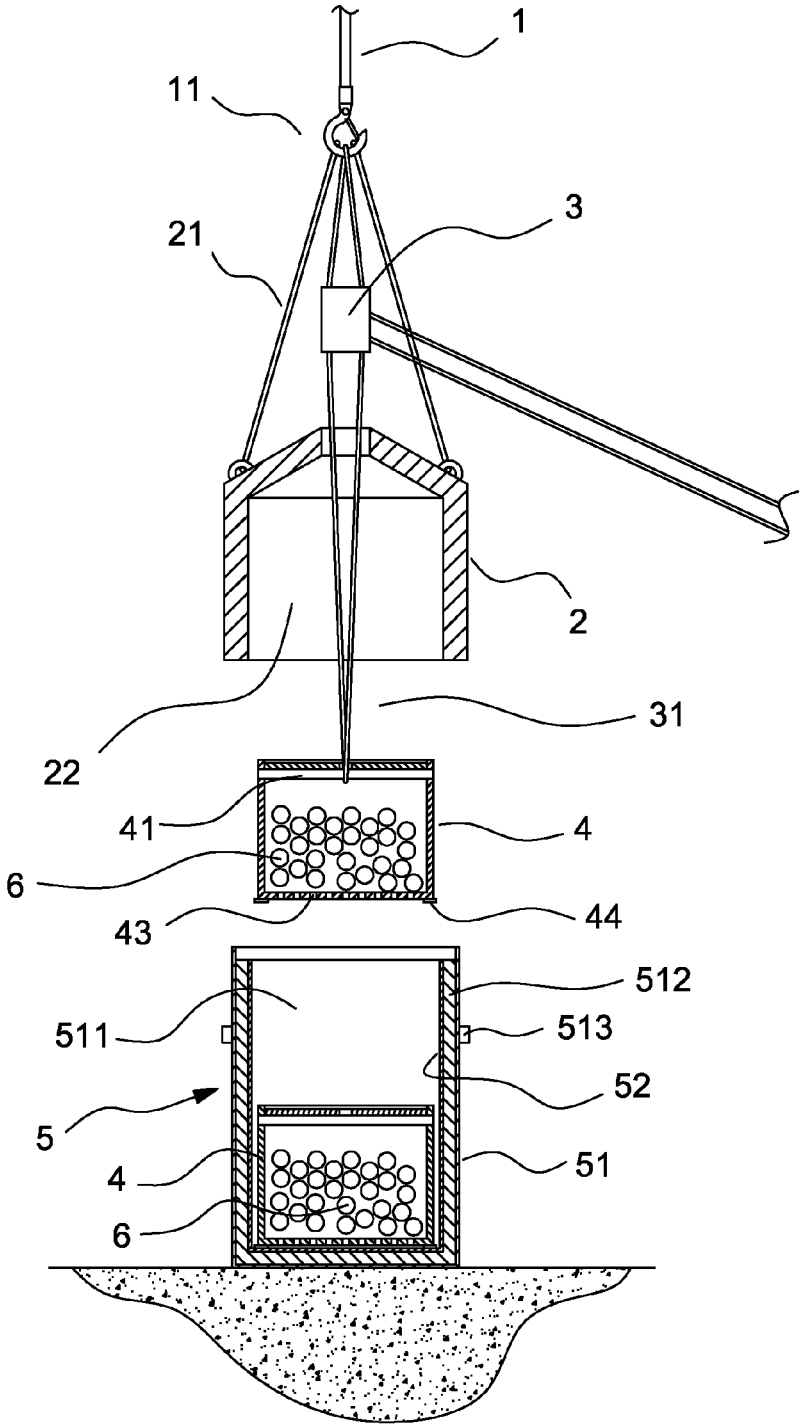
FIG. 6 is a schematic view showing operation of placing the net basket in the shielding container for temporary storage in accordance with the present invention.
Figure 8:
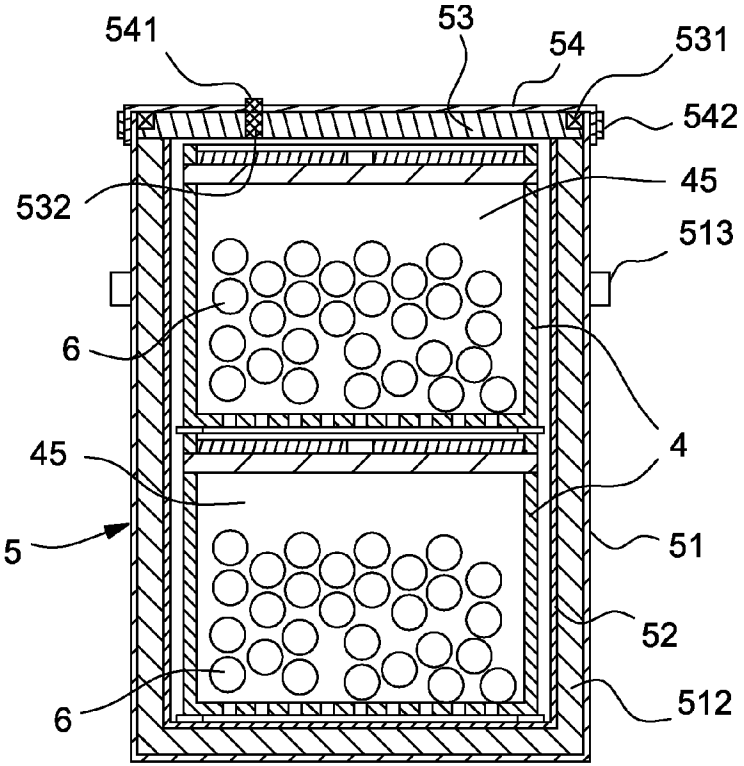
FIG. 8 is a schematic view showing operation of sealing the shielding container for temporary storage at the second time in accordance with the present invention.
Figure 7:
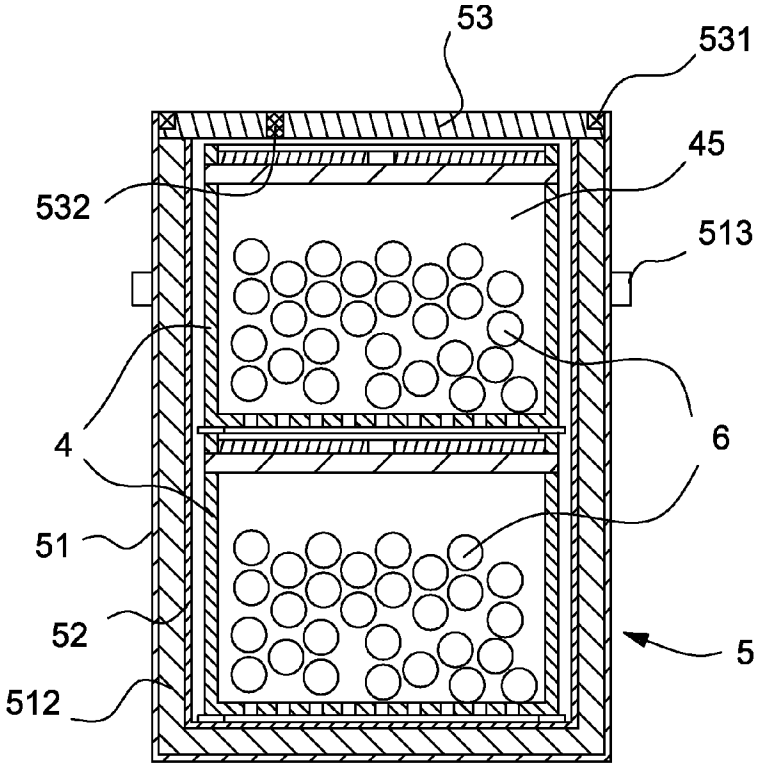
FIG. 7 is a schematic view showing operation of sealing the shielding container for temporary storage at the first time in accordance with the present invention.

Referring to FIGS. 4-8 and a flow chart illustrated in FIG. 1, a method in accordance with the present invention includes step S11 of moving a net basket into a water container containing high radiation intensity waste, comprising using a hanging device, i.e. the hanging mechanism 1 and the manual lifting mechanism 3, to move the net basket 4 into a container 7 storing the high radiation intensity waste 6, shaped like particles or powder, wherein water 70 contained in the container 7 is provided for obstructing radiation of the high radiation intensity waste 6, and using a pump 71 having pipes 711 and 712 at inputs and outputs of the pump 71, respectively, to suck the high radiation intensity waste 6, in the container 7, through the pipe 711 and to discharge the high radiation intensity waste 6 into the net basket 4 through the pipe 712, as shown in FIG. 4; step S12 of moving the net basket and the high radiation intensity waste collected in the net basket out of water and putting the waste in a lead shield, comprising lifting the net basket 4 and the high radiation intensity waste 6 collected in the net basket 4 to a space above the container 7 and simultaneous putting the waste 6 in the space 22 in the lead shield 2 such that the high radiation intensity waste 6 in the net basket 4 can be drip-dried in the lead shield 2 with limited radiation leakage through the multiple meshes 4, as shown in FIG. 5; step S13 of moving the net basket and the high radiation intensity waste collected in the net basket to a shielding container for temporary storage, comprising using the hanging device, i.e. the hanging mechanism 1 and the manual lifting mechanism 3, to move the net basket 4 and the dried high radiation intensity waste 6 collected in the net basket 4 to the shielding container 5 for temporary storage, as shown in FIG. 6; step 14 of determining if the shielding container for temporary storage is suitable for containing another net basket, comprising confirming if in the shielding container 5 for temporary storage is enough space suitable for accommodating another net basket and performing step 13 of moving another net basket and the high radiation intensity waste collected in the net basket to the shielding container for temporary storage in response to confirming that in the shielding container 5 for temporary storage is enough space suitable for accommodating another net basket such that in the shielding container 5 for temporary storage can receive sufficient quantity of a plurality of the net basket 4 firmly stacked by the anti-roll plates 44; finally, step S15 of sealing the shielding container for temporary storage, comprising first using the shielding top 53 to cover the opening of the space 511 in the containing body 51 and lock using the locks 531, as shown in FIG. 7, and then using the sealing ring 542 to lead the outer lid 54 to cover and fix to an outer surface of the shielding top 53 such that the high radiation intensity waste 6 in the net basket 4 can be sealed in the shielding container 5 for temporary storage.

In accordance with the present invention, the filtering and pressure-venting device 541 of the outer lid 54 is assembled to correspond to the filtering and pressure-venting device 532 of the shielding top 53. When the shielding container 5 for temporary storage has an excessive air pressure, the filtering and pressure-venting devices 532 and 541 may filter discharged air and vent pressure in the shielding container 5 so as to avoid air accumulation releasing due to chemical changes created by the high radiation intensity waste 6 and avoid air pollution.

Accordingly, in accordance with the present invention, a method for portioning high radiation intensity waste and apparatus thereof can be employed for avoiding exposure to the environment with high radiation intensity during the portioning process, and the shielding container for temporary storage has functions of sealing, filtering and pressure venting and the waste is easily taken out. The present invention is ensured to meet industrial applicability, novelty and inventive steps.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A method for portioning high radiation intensity waste, comprising:

step S11: using a hanging device to move a net basket into a water container storing the high radiation intensity waste and using a pump to pump the high radiation intensity waste into the net basket;

step S12: lifting the net basket and the high radiation intensity waste collected in the net basket to a space above the water container and putting the waste in a lead shield during lifting the net basket such that the high radiation intensity waste in the net basket can be dried;

step S13: moving the net basket and the dried high radiation intensity waste collected in the net basket to a shielding container for temporary storage; and step S15: sealing the net basket and the dried high radiation intensity waste collected in the net basket in the shielding container for temporary storage.

2. The method of claim 1, wherein before the step S15, further comprising step S14 of determining if the shielding container for temporary storage is suitable for containing another net basket, comprising confirming if in the shielding container for temporary storage is enough space suitable for accommodating another net basket and performing step S13 of moving another net basket and the high radiation intensity waste collected in the another net basket to the shielding container for temporary storage in response to confirming that in the shielding container for temporary storage is enough space suitable for accommodating another net basket.

* * * * *